US008512052B2

(12) United States Patent
Garvin

(10) Patent No.: US 8,512,052 B2
(45) Date of Patent: Aug. 20, 2013

(54) ELECTRICAL GROUNDING DEVICE AND SYSTEM

(76) Inventor: Barton L. Garvin, Western Springs, IL (US)

( * ) Notice: Subject to any disclaimer, the term of this patent is extended or adjusted under 35 U.S.C. 154(b) by 0 days.

(21) Appl. No.: 13/562,958

(22) Filed: Jul. 31, 2012

(65) Prior Publication Data

US 2013/0025905 A1 Jan. 31, 2013

Related U.S. Application Data

(63) Continuation of application No. 12/856,441, filed on Aug. 13, 2010, now Pat. No. 8,231,392.

(60) Provisional application No. 61/234,228, filed on Aug. 14, 2009.

(51) Int. Cl.
*H01R 13/648* (2006.01)
*H01R 4/66* (2006.01)

(52) U.S. Cl.
USPC ..... 439/100

(58) Field of Classification Search
USPC ..... 439/100, 92, 101
See application file for complete search history.

(56) References Cited

U.S. PATENT DOCUMENTS

| | | | | |
|---|---|---|---|---|
| 3,492,625 | A * | 1/1970 | Bromberg | 439/100 |
| 3,967,872 | A * | 7/1976 | Mooney et al. | 439/100 |
| 4,159,859 | A * | 7/1979 | Shemtov | 439/100 |
| 4,189,198 | A * | 2/1980 | Reichman | 439/100 |
| 6,840,782 | B1 * | 1/2005 | Borden et al. | 439/92 |

* cited by examiner

*Primary Examiner* — Javaid Nasri
(74) *Attorney, Agent, or Firm* — J. Peter Paredes; Rosenbaum IP

(57) ABSTRACT

An electrical grounding device includes a first and a second collar member, each having inner and outer wall surfaces, a flange projecting from the inner wall surface, and a shoulder projection extending radially from the outer wall surface. Further, the device includes a thickened wall region including an aperture passing transversely therethrough, wherein the thickened wall region is disposed in the outer wall surface of at least one of the first and second collar members. A fastener is operably associated with the shoulder projections of the first and second collar members to removably couple the shoulder projections together. Such coupling configures the inner wall surfaces to define an opening disposed through the electrical grounding device.

17 Claims, 4 Drawing Sheets

ELECTRICAL GROUNDING DEVICE AND SYSTEM

CROSS-REFERENCE TO RELATED APPLICATIONS

The present application is a continuation of U.S. patent application Ser. No. 12/856,441, filed Aug. 13, 2010, now U.S. Pat. No. 8,231,392, which claims the benefit of priority to U.S. Provisional Application Ser. No. 61/234,228, filed Aug. 14, 2009, each incorporated herein by reference in their entirety.

FIELD OF THE INVENTION

The present invention relates generally to an electrical grounding device. More particularly, the present invention relates to a grounding collar bushing having a removable ground lug member.

BACKGROUND OF THE INVENTION

In residential and commercial construction, an entire electrical system of a structure is grounded to Earth to create a path to a zero potential. This is typically achieved by coupling a large grounding wire or wires from a junction box or other electrical source on the structure to a ground stake which is buried underground. The grounding wire(s) are typically fed through electrical conduit, i.e., larger diameter pipes that are buried in the ground. A grounding bushing is typically installed on a terminal end of the electrical conduit at an electrical junction box so as to reduce the likelihood that the electrical conducting materials will improperly contact either the electrical junction box or the conduit terminus. Without a properly installed bushing in place, the ground wires and/or electrical conductors may become damaged and/or the electrical conduit may become electrically charged, leading to unsafe conditions. The grounding bushing provides a lined aperture through which ground wires and/or electrical conductors pass and helps to ensure that the junction between the grounding wires and the electrical conduit is protected both electrically and against chafe. Grounding bushings have the additional capability of being grounded themselves.

Collar type grounding bushings are typically fitted during the initial installation of the electrical system. The complete disassembly of a grounding circuit may be necessary to retrofit or repair a collar type ground bushing. One solution to this difficulty is to provide a split collar type grounding bushing as described in U.S. Pat. No. 6,840,782, which discloses a two-piece hinged collar-type grounding bushing including a fixed position ground lug. However, the hinged design and fixed position ground lug make the bushing unwieldy in applications where space is at a premium.

Accordingly, there exists a need for an alternative electrical grounding collar bushing. Such a grounding collar bushing benefits from the ability of a user to readily retrofit a grounding conduit without pulling the ground wires and reassembling the grounding circuit. The inventive grounding collar bushing also benefits from highly adaptable positions for varying installation conditions and the location of the ground lug based upon the particular circumstances of the installation conditions encountered by the user.

SUMMARY OF THE INVENTION

In one aspect of the current invention, an electrical grounding device includes a first collar member having first inner and outer wall surfaces, a first flange projecting from the first inner wall surface, and a first shoulder projection extending radially from the first outer wall surface. The device further includes a second collar member having second inner and outer wall surfaces, a second flange projecting from the second inner wall surface, and a second shoulder projection extending radially from the second outer wall surface. Further, the device includes a thickened wall region including an aperture passing transversely therethrough, wherein the thickened wall region is disposed in the outer wall surface of at least one of the first and second collar members. A fastener is operably associated with the first and second shoulder projections to removably couple the first and second shoulder projections together. Such coupling configures the first and second inner wall surfaces to define an opening disposed through the electrical grounding device.

In another aspect of the current invention, an electrical grounding device includes a first collar member having first inner and outer wall surfaces, a first flange projecting from and co-extensive with the first inner wall surface, and a first shoulder projection extending radially from the first outer wall surface. The device further includes a second collar member having second inner and outer wall surfaces, a second flange projecting from and co-extensive with the second inner wall surface, and a second shoulder projection extending radially from the second outer wall surface. Further, the device includes first and second chafe guard members coupled to the first and second flanges, respectively, and a plurality of thickened wall regions each including an aperture passing transversely therethrough. The thickened wall regions are disposed in the first and second outer wall surfaces and positioned in a spaced-apart relationship about a circumferential axis of the electrical grounding device. A ground lug member is removably coupled to at least one of the plurality of thickened wall regions and a fastener is operably associated with the first and second shoulder projections to removably couple the first and second shoulder projections together. Such coupling configures the first and second chafe guard members to define an opening disposed through the electrical grounding device.

In a further aspect of the current invention, an electrical grounding system includes a ground pipe partially buried in the earth and having an open end thereof and at least one ground wire electrically coupled to an electrically conductive structure. The at least one ground wire passes into and through the open end of the ground pipe and electrically grounded to earth. The electrical grounding system further includes an electrical grounding device removably coupled to and in an abutting relationship with the open end of the ground pipe. The electrical grounding device includes a first collar member having first inner and outer wall surfaces, a first flange projecting from the first inner wall surface, and a first shoulder projection extending radially from the first outer wall surface. The electrical grounding device further includes a second collar member having second inner and outer wall surfaces, a second flange projecting from the second inner wall surface, and a second shoulder projection extending radially from the second outer wall surface. Further, the device includes a thickened wall region including an aperture passing transversely therethrough. The thickened wall region is disposed in the outer wall surface of at least one of the first and second collar members. A fastener is operably associated with the first and second shoulder projections to removably couple the first and second shoulder projections together. Such coupling configures the first and second inner wall surfaces to define an opening disposed through the electrical grounding device.

Other objects of the present invention, as well as particular features, elements, and advantages thereof, will be elucidated or become apparent from, the following description, appending claims, and the accompanying drawing figures.

BRIEF DESCRIPTION OF THE DRAWINGS

The foregoing and other features and advantages of the disclosure are apparent from the following detailed description of exemplary embodiments, read in conjunction with the accompanying drawings; wherein like structural or functional elements may be designated by like reference numerals.

DETAILED DESCRIPTION OF THE PREFERRED EMBODIMENTS

FIGS. 1-6 illustrate an embodiment of an electrical grounding device 10 including two first and second collar members 12, 14. Each of the first and second collar members 12, 14 includes an inner wall surface 13, an outer wall surface 15, and a height defined between ends of the device 10. The first and second collar members 12, 14 may form any polygonal shape as desired, including by way of example and not limitation, a ring, circle, or an oval-like shape when mechanically coupled. In one embodiment, the first and second collar members 12, 14 are generally symmetrical and arcuate, each having an arc-length that spans about half-way (or about 180 degrees or about $\pi$ radians) around the electrical grounding device. Other embodiments include configurations wherein the first and second collar members 12, 14 are asymmetric and span different arc-lengths around the device 10, for example, 170 and 190 degrees, respectively, or other arc-lengths that are other than 180 degrees.

Figure 3:
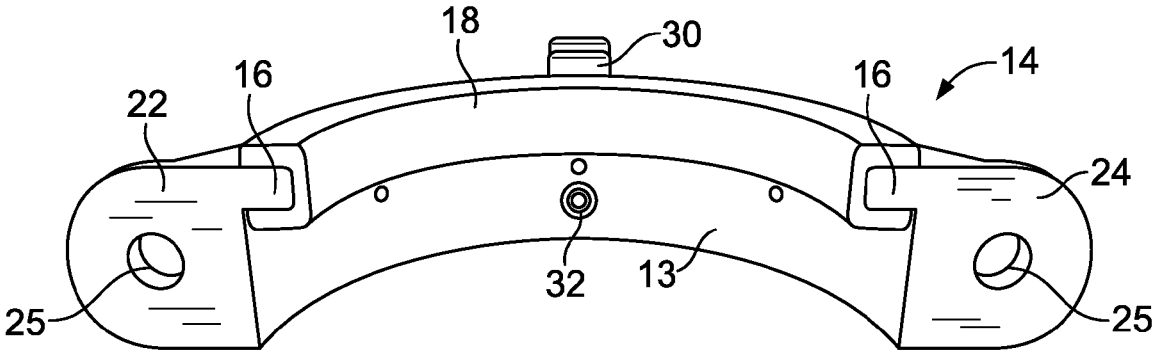
FIG. 3 is a perspective view of a first collar member of the grounding device of FIG. 1.

As best seen in FIG. 3, flange 16 projects inwardly from the inner wall surface 13. In this embodiment, the flange 16 is disposed at an end of the device 10; however, in other embodiments, the flange 16 may be disposed between the ends of the device 10. In this embodiment, the flange 16 is generally perpendicular to the inner wall surface 13; however, in other embodiments, the flange 16 may be angled toward the first end or toward the second end of the electrical grounding device. The flange 16 is arcuate and follows the curvature of the inner wall 13.

Figure 2:
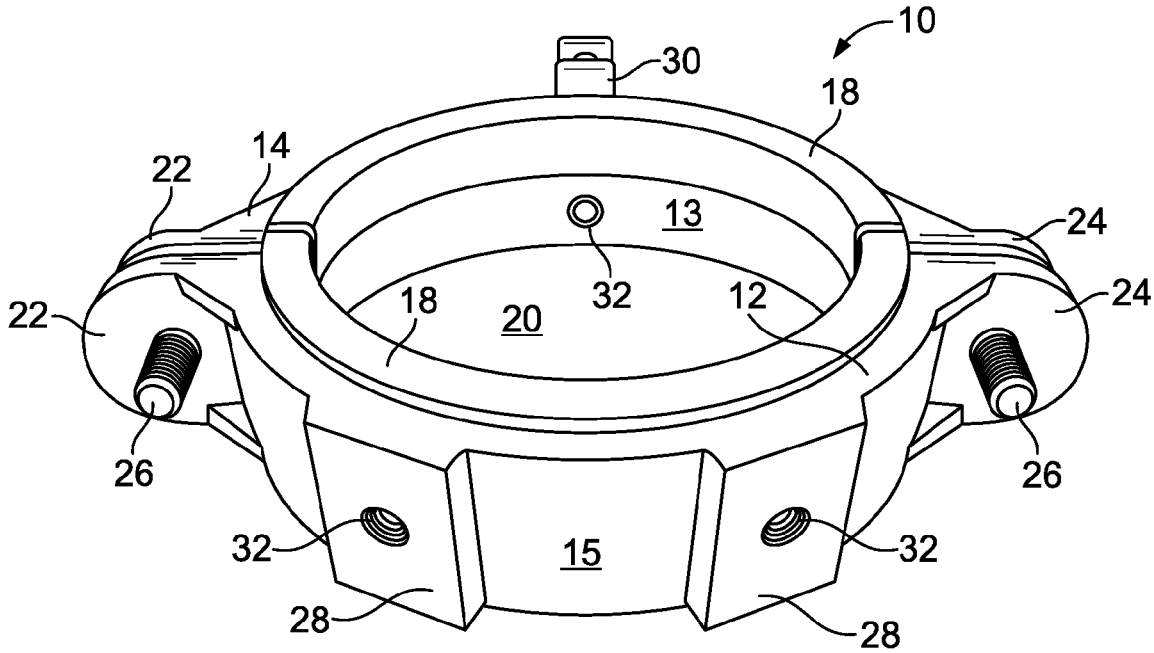
FIG. 2 is a perspective view of the grounding device of FIG. 1.
Figure 7:
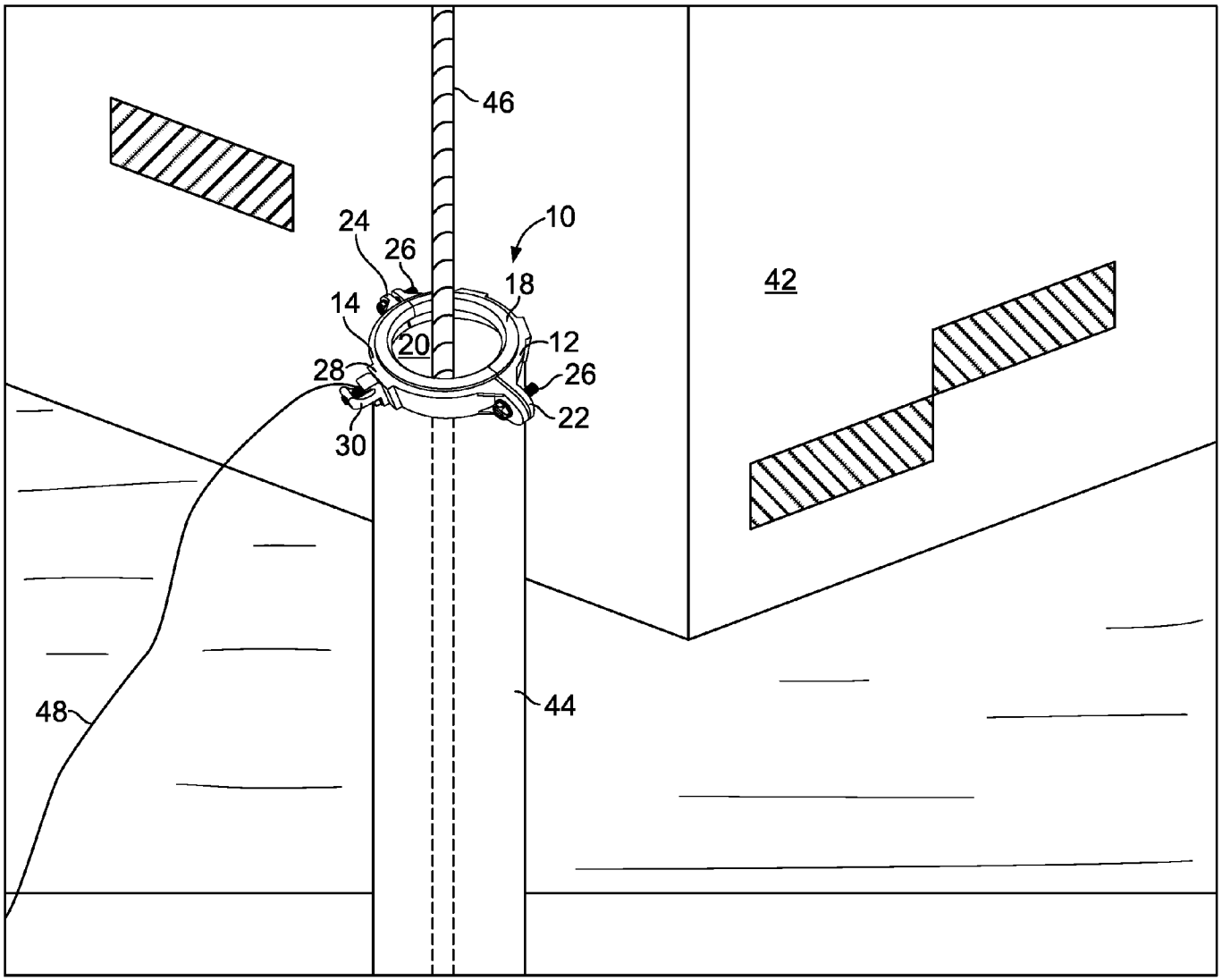
FIG. 7 is illustrates attachment of the electrical grounding device to a ground wire pipe.

A central opening 20 is defined by the inner wall surface 13 and an inner surface of the flange 16, as illustrated in FIG. 2. Referring to FIG. 3, in one embodiment, a chafe guard member 18 is provided in association with the flange 16. The chafe guard member 18 attaches over and covers one or more surfaces of the flange 16 and thereby provides a protective insulative lining to the flange 16. Thus the chafe guard member 18 mechanically and electrically isolates ground wire(s) 46 that may pass into and through the central opening 20 from contacting the flange 16 directly, as shown in FIG. 7. In this manner, the flange 16 serves as an abutting surface for an end lip of a ground wire conduit or pipe 44 (FIG. 7), when the device 10 is installed.

Each of the first and second collar members 12, 14 has first and second diametrically opposed shoulder projections 22, 24 that extend outward radially therefrom. Each of the first and second shoulder projections has an opening 25 passing transversely therethrough as shown in FIG. 3. In one embodiment, axes passing centrally through each opening 25 are skew to an axis passing centrally through the central opening 20. In another embodiment, at least one of the axes passing centrally through the openings 25 is parallel to the axis passing centrally through the central opening 20.

In one embodiment, fastener 26 is engaged through the opening 25 and tightened in order to mate the first and second collar members 12, 14 by bringing the first and second shoulder projections 22, 24 into intimate contact with each other. One or both of the openings 25 in each of the shoulder projections 22, 24 may be threaded. The fasteners 26 contemplated as being within the scope of the present invention, include by way of example and not limitation, a screw, a bolt, a nut associated with a screw or a bolt, an engaging pin, such as a cotter pin, or a clasp-type or press fit arrangement that would engage an opposing shoulder projection and hold opposing shoulder projections 22, 24 in contact with each other.

When the fastener 26 is engaged and secured, each of the first and second collar members 12, 14 are joined to form the electrical grounding device 10, as shown in FIGS. 1, 2 and 4-7. In its joined configuration, the flange 16 defines a first region of the central opening 20 and the inner wall surface 13 defines a second region of the central opening 20.

Figure 1:
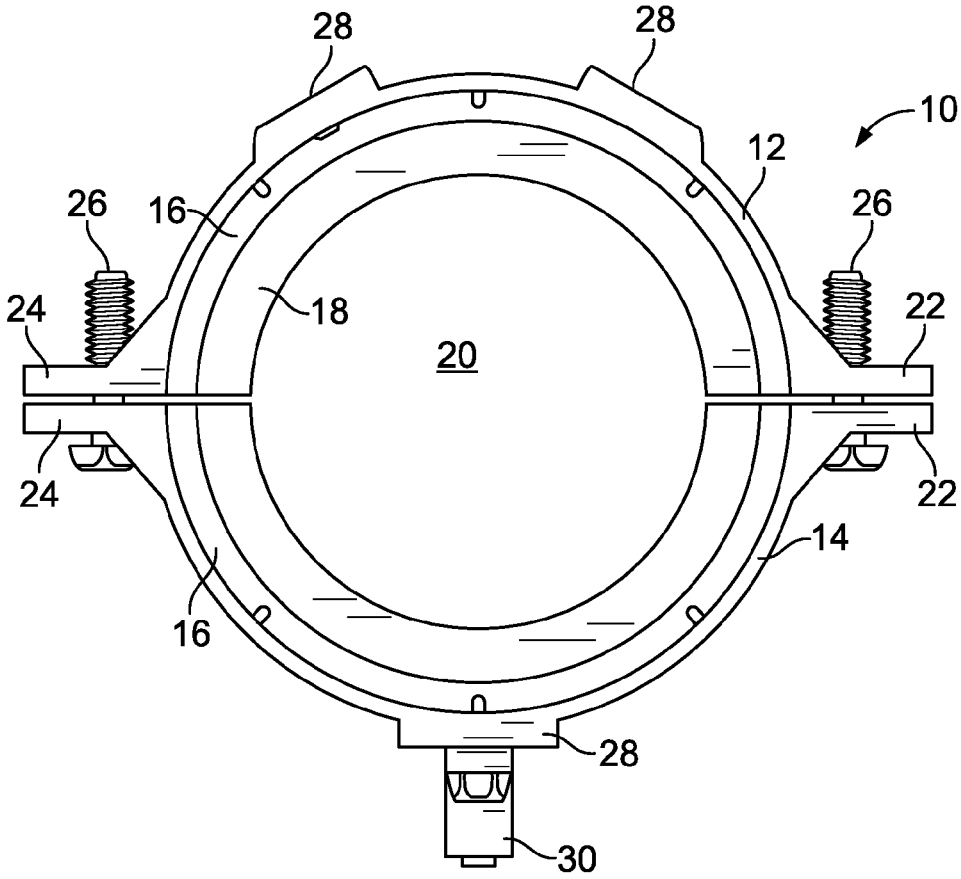
FIG. 1 an elevational view of a first end of an embodiment of a grounding device.

FIG. 1 shows thickened wall regions 28 projecting radially from the outer wall surface 15 of the first and second collar member 12, 14. In one embodiment, the thickened wall regions 28 include threaded openings 32 passing thereinto and/or therethrough. In one embodiment, the thickened wall regions 28 extend over the height of the outer wall surface 15; however, in other embodiments, the thickened wall regions 28 extend over a portion of the outer wall 15 between the first and second ends of the device 10. In one embodiment, the thickened wall regions 28 are positioned in a spaced-apart relationship about a circumferential axis of the electrical grounding device 10 at positions pre-selected at the time of manufacture. A plurality of the thickened wall regions 28 allows a user to select a suitable position for the ground lug member 30 prior to, during, or after the installation of the electrical grounding device 10.

Figure 4:
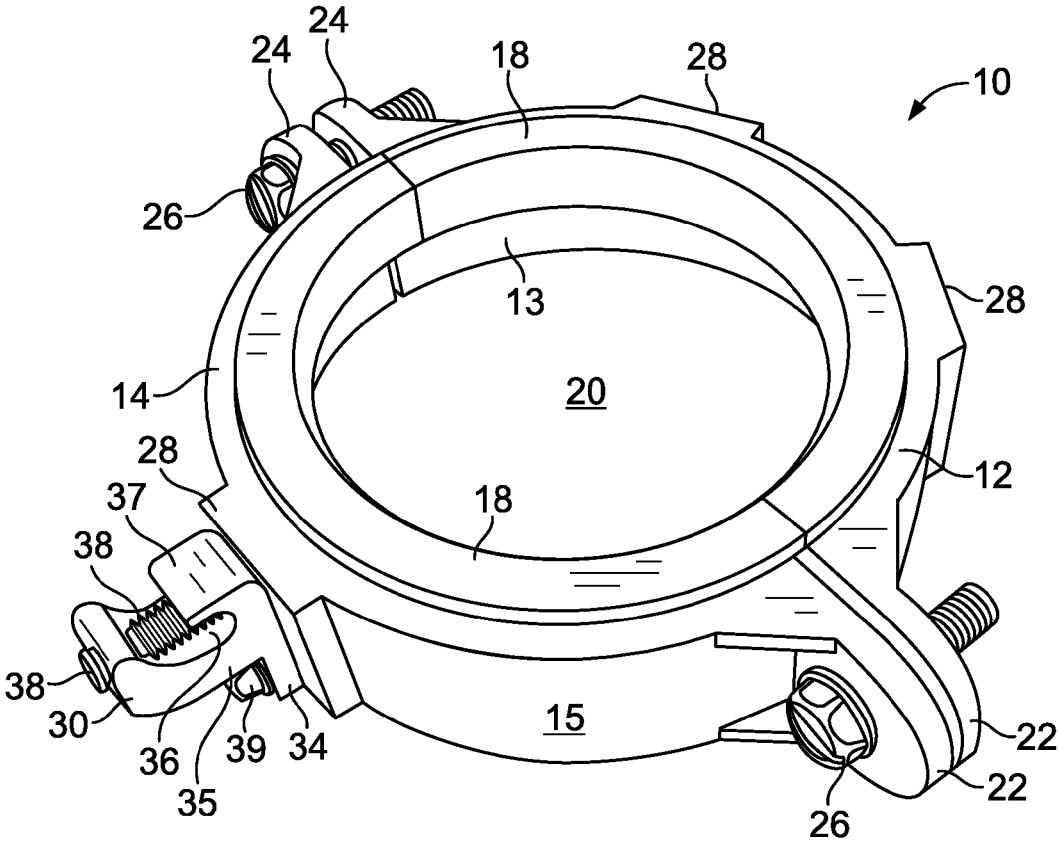
FIG. 4 is another perspective view of the grounding device of FIG. 1.
Figure 5:
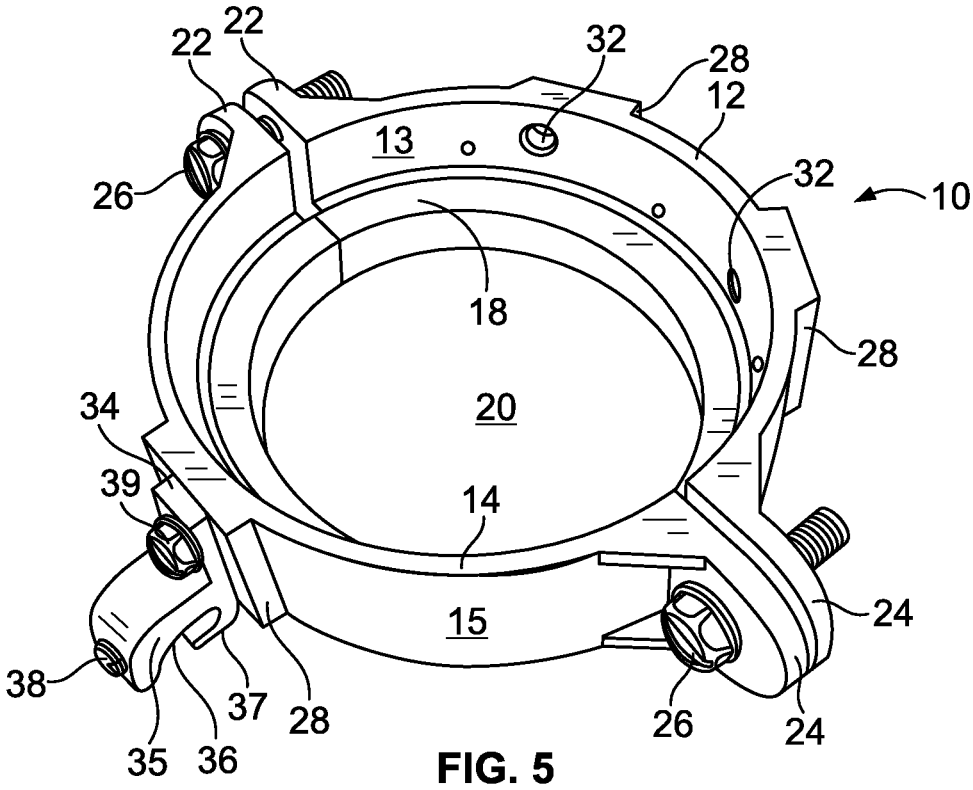
FIG. 5 is a further perspective view of the grounding device of FIG. 1.
Figure 6:
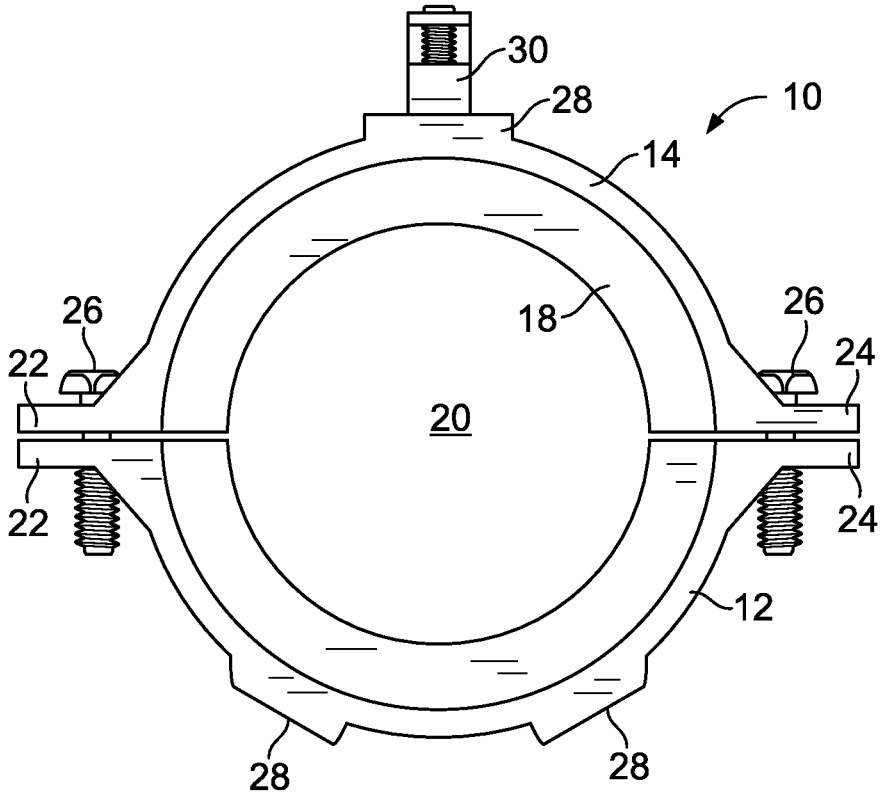
FIG. 6 is an elevational view of a second end of the grounding device of FIG. 1.

In one embodiment, as shown in FIGS. 4 and 5, the ground lug member 30 is removably coupled to the thickened wall region 28 by a ground lug connector 39, which is preferably a screw or a bolt; however, the ground lug connector 39 may be any fastener as known in the art. In this embodiment, the ground lug connector 39 passes through an opening disposed through a ground lug base portion 34 of the ground lug member 30 to permit removable attachment of the ground lug member 30 to the thickened wall region 28. The ground lug base 34 is configured to couple to the thickened wall region 28 and be in intimate mechanical and electrical contact therewith.

In one embodiment, a ground wire seat 37 projects from the ground lug base 34 and may be generally perpendicular thereto. A ground lug projection 35 projects outwardly from the ground lug base 34 and includes an end section that is generally parallel to an outer surface of the thickened wall region 28 to which the ground lug member 30 is attached. The end section of the ground lug projection 35 includes a threaded opening disposed therethrough to accommodate a retention member, for example, a ground lug set screw 38. The ground lug set screw 38 passes transversely through the end section and is generally parallel to the diametric axis of the electrical grounding device 10. When fully engaged, the ground lug set screw 38 impinges upon and/or contacts a collar ground wire 48 to retain the collar ground wire 48 between the ground wire seat 37 and the ground lug projection 35. Other embodiments include other configurations for attaching the collar ground wire 48 to the ground lug member as may be known in the art.

In use, the first and second collar members 12, 14 are decoupled from each other and fitted in abutting relationship over an end of a ground pipe 44 that is adjacent a building 42, as depicted in FIG. 7. The central opening 20 cooperates with the opening in the ground pipe 44 to permit ground wire 46 to pass through the central opening 20. The fasteners 26 are used to connect the first and second collar members 12, 14 by mating the first and second shoulder projections 22, 24. The fasteners 26 are tightened to secure the electrical grounding device 10 in a desired position at the end of the ground pipe 44. The ground lug member 30 is then attached at an exposed and available thickened wall region 28, and the ground collar device 10 is grounded using the collar ground wire 48.

An improved electrical grounding system and device are presented. The device includes two members that join to form a collar having a chafe guard member electrically and mechanically isolating an interior surface of the collar from grounding wires disposed therethrough. A removable ground lug member is joinable to an exterior surface of the collar.

While the present invention has been described with reference to its preferred embodiments, those of ordinary skill in the art will understand and appreciate that variations in materials, dimensions, geometries, and fabrication methods may be or become known in the art, yet still remain within the scope of the present invention which is limited only by the claims appended hereto. It is understood, therefore, that this disclosure is not limited to the particular embodiments disclosed, but it is intended to cover modifications that may include a combination of features illustrated in one or more embodiments with features illustrated in any other embodiments. Various modifications, equivalent processes, as well as numerous structures to which the present disclosure may be applicable will be readily apparent to those of skill in the art to which the present disclosure is directed upon review of the present specification. Accordingly, this description is to be construed as illustrative only and is presented for the purpose of enabling those skilled in the art to make and use the electrical grounding system and device described herein and to teach the best mode of carrying out the same.

What is claimed is:

1. An electrical grounding device comprising:

a. a first collar member and a second collar member that, when cooperatively joined to each other form generally a ring structure with a central opening, the first collar member having first inner and outer wall surfaces, a first flange projecting from the first inner wall surface, a first shoulder projection extending radially from the first outer wall surface with an aperture disposed therethrough that is orthogonal to the central opening, and a second shoulder projection extending radially from the first outer wall surface with an aperture disposed therethrough that is orthogonal to the central opening;

b. the second collar member having second inner and outer wall surfaces, a second flange projecting from the second inner wall surface, a third shoulder projection extending radially from the second outer wall surface with an aperture disposed therethrough that is orthogonal to the central opening, and a fourth shoulder projection extending radially from the second outer wall surface with an aperture disposed therethrough that is orthogonal to the central opening;

c. a ring shaped chafe guard member coupled to the first and second flanges; and d. a plurality of fasteners operably associated with the first and second collar members and passing through the apertures disposed through the first, second, third, and fourth shoulder projections to removably couple the first, second, third, and fourth shoulder projections together.

2. The electrical grounding device of claim 1, wherein the aperture disposed on at least one of the first, second, third, and fourth shoulder projections is a threaded aperture disposed therethrough.

3. The electrical grounding device of claim 2, wherein at least one of the plurality of fasteners comprises a threaded member that engages the threaded aperture.

4. The electrical grounding device of claim 1, wherein the first and second flanges are coextensive with the first and second inner wall surfaces, respectively.

5. The electrical grounding device of claim 4, wherein each of the first and second collar members subtend an arc length of other than about 180 degrees.

6. The electrical grounding device of claim 1, further comprising a ground lug member removably coupled to at least one of the first or second collar members.

7. The electrical grounding device according to claim 6, further comprising a fastener removably connecting the ground lug member to the at least one of the first or second collar members by engagement with an aperture passing transversely through the at least one of the first or second collar members.

8. The electrical grounding device according to claim 7, wherein the ground lug member further comprises a base member, a first projection extending from the base member, a second projection extending from the base member and including an end section that is generally parallel to an outer surface of the at least one of the first or second collar members, and a retention member, wherein the ground lug member is adapted to retain a ground wire between the first projection and the second projection.

9. The electrical grounding device according to claim 8, wherein the end section includes a threaded opening and the retention member comprises a set screw cooperating with the threaded opening.

10. An electrical grounding device comprising:

a. a first collar member and a second collar member that, when cooperatively joined to each other form generally a ring structure with a central opening, the first collar member having first inner and outer wall surfaces, a first flange projecting from the first inner wall surface, a first shoulder projection extending radially from the first outer wall surface with an aperture disposed therethrough that is orthogonal to the central opening, and a second shoulder projection extending radially from the first outer wall surface with an aperture disposed therethrough that is orthogonal to the central opening;

b. the second collar member having second inner and outer wall surfaces, a second flange projecting from the second inner wall surface, a third shoulder projection extending radially from the second outer wall surface with an aperture disposed therethrough that is orthogonal to the central opening, and a fourth shoulder projection extending radially from the second outer wall surface with an aperture disposed therethrough that is orthogonal to the central opening;

c. a ring shaped chafe guard member coupled to the first and second flanges;

d. a ground lug member removably coupled to at least one of the first or second collar members; and e. a fastener operably associated with the first and second collar members and passing through the apertures disposed through the first, second, third, and fourth shoulder projections to removably couple the first and second collar members together.

11. The electrical grounding device of claim 10, wherein the aperture disposed on at least one of the first, second, third, and fourth shoulder projections is a threaded aperture disposed therethrough and the fastener comprises a threaded member that engages the threaded aperture.

12. The electrical grounding device according to claim 10, further comprising a fastener removably connecting the ground lug member to the at least one of the first or second collar members by engagement with an aperture passing transversely through the at least one of the first or second collar members.

13. An electrical grounding system, comprising:

a. a ground pipe partially buried in the earth and having an open end thereof;

b. at least one ground wire electrically coupled to an electrically conductive structure, the at least one ground wire passing into and through the open end of the ground pipe and electrically grounded to earth; and c. an electrical grounding device removably coupled to and in an abutting relationship with the open end of the ground pipe, the electrical grounding device further comprising:

i. a first collar member and a second collar member that, when cooperatively joined to each other form generally a ring structure with a central opening, the first collar member having first inner and outer wall surfaces, a first flange projecting from the first inner wall surface, a first shoulder projection extending radially from the first outer wall surface with an aperture disposed therethrough that is orthogonal to the central opening, and a second shoulder projection extending radially from the first outer wall surface with an aperture disposed therethrough that is orthogonal to the central opening;

ii. the second collar member having second inner and outer wall surfaces, a second flange projecting from the second inner wall surface, a third shoulder projection extending radially from the second outer wall surface with an aperture disposed therethrough that is orthogonal to the central opening, and a fourth shoulder projection extending radially from the second outer wall surface with an aperture disposed therethrough that is orthogonal to the central opening;

iii. a ring shaped chafe guard member coupled to the first and second flanges; and iv. a fastener operably associated with the first and second collar members and passing through the apertures disposed through the first, second, third, and fourth shoulder projections to removably couple the first and second collar members together.

14. The electrical grounding system of claim 13, wherein the first and second flanges are coextensive with the first and second inner wall surfaces, respectively.

15. The electrical grounding system of claim 13, further comprising a ground lug member removably coupled to at least one of the first or second collar members.

16. The electrical grounding system of claim 13, wherein the aperture disposed on at least one of the first, second, third, and fourth shoulder projections is a threaded aperture disposed therethrough.

17. The electrical grounding system of claim 16, wherein the fastener comprises a threaded member that engages the threaded aperture.

* * * * *